United States Patent [19]

Rohs

[11] 4,013,229

[45] Mar. 22, 1977

[54] INJECTION NOZZLE FOR LIQUIDS, PARTICULARLY FOR FUELS

[76] Inventor: Ulrich Rohs, Roonstrasse 11, D 516 Duren, Germany

[22] Filed: Feb. 19, 1975

[21] Appl. No.: 551,132

[30] Foreign Application Priority Data

Feb. 19, 1974 Germany ..... 2407856

[52] U.S. Cl. ..... 239/493; 239/533.14

[51] Int. Cl.[2] ..... B05B 1/34

[58] Field of Search ..... 239/533, 534, 535, 491, 239/493, 469, 470, 492

[56] References Cited

UNITED STATES PATENTS

| | | | |
|---|---|---|---|
| 501,178 | 7/1893 | Bourdil | 239/469 |
| 1,439,320 | 12/1922 | Morse | 239/492 X |
| 1,440,705 | 1/1923 | Sumner | 239/492 X |
| 2,052,560 | 9/1936 | French | 239/535 |
| 2,805,891 | 9/1957 | Sanborn | 239/535 |
| 2,965,311 | 12/1960 | Gascoigne | 239/534 X |
| 3,545,682 | 12/1970 | Beard | 239/534 X |

*Primary Examiner*—Evon C. Blunk
*Assistant Examiner*—Michael Mar
*Attorney, Agent, or Firm*—Diller, Brown, Ramik & Wight

[57] ABSTRACT

This relates to an injection nozzle which includes a nozzle body having at one end thereof an inlet channel which is connected to an annular spinning chamber which is connected to the inlet channel by means of spin channels directed tangentially into the spinning chamber, and an exhaust orifice. The exhaust orifice is formed in a closure plate which cooperates with a core of the nozzle body disposed within the general confines of the annular spinning chamber to define a very narrow gap through which injected liquids flowing from the spinning chamber must pass in order to flow into the discharge orifice. The cross section of the exhaust orifice is materially greater than the cross section of the gap, thereby providing a much greater ratio of the smallest amount of liquid which may possibly be injected to the largest amount.

9 Claims, 6 Drawing Figures

INJECTION NOZZLE FOR LIQUIDS, PARTICULARLY FOR FUELS

This invention relates in general to new and useful improvements in injection nozzles for liquids, and more particularly to an injection nozzle particularly adapted for the injection of fuels.

This invention specifically relates to an injection nozzle for liquids, especially fuels, which includes a nozzle body having an inlet channel, a spinning chamber connected to the inlet channel by spin channels which open tangentially into the spinning chamber, and an exhaust channel. With respect to known injection nozzles of this type, the ratio of the smallest amount of injection to the largest amount of injection, that is the so-called injection ratio, is on the order of 1 : 15. Thus, the range of adjustments of such prior nozzles is fairly limited. This invention is directed to the problem of creating an injection nozzle of an appreciably larger injection ratio range, for example, on the order of 1 : 100, so that the nozzle may be adapted to wide differences in load, and so that it is feasible to operate internal combustion engines with various fuels utilizing the same injection nozzle.

In accordance with the invention, the higher injection ratio goal may be achieved by forming the spinning chamber essentially as an annular recess in the nozzle body in association with a cover plate for the end of the nozzle body, the cover plate forming a disc-like gap with an end surface of a core defined on the end of the nozzle body by the spinning chamber, and the exhaust channel being in the form of an exhaust orifice located in the cover plate in communication with the spinning chamber via the gap, and the cross section of the exhaust orifice being materially greater than the cross section of the gap.

In the prior injection nozzles, the most restricted portion of the nozzle was the injection bore or exhaust channel or exhaust orifice. However, in accordance with this invention, the most restricted portion of the nozzle is located ahead of the exhaust orifice or injection bore. In this manner, one obtains an injection ratio or spray ratio which heretofore was considered to be unfeasible by experts in the art.

In one embodiment of the invention, the nozzle body is provided with a bore opening through the core thereof with this bore being aligned with the exhaust orifice and directly opened theretowards and which bore is located with respect to liquid flow behind the gap between the cover plate and the end of the core and ahead of the exhaust orifice. The sharp edge formed by the bore contributes to better atomization of the liquid being injected.

It has also been found to be advantageous with respect to a further embodiment of the invention for the bore in the nozzle body to be a through bore and thus form a return channel.

With the above and other objects in view that will hereinafter appear, the nautre of the invention will be more clearly understood by reference to the following detailed description, the appended claims and the several views illustrated in the accompanying drawings:

Figure 1:
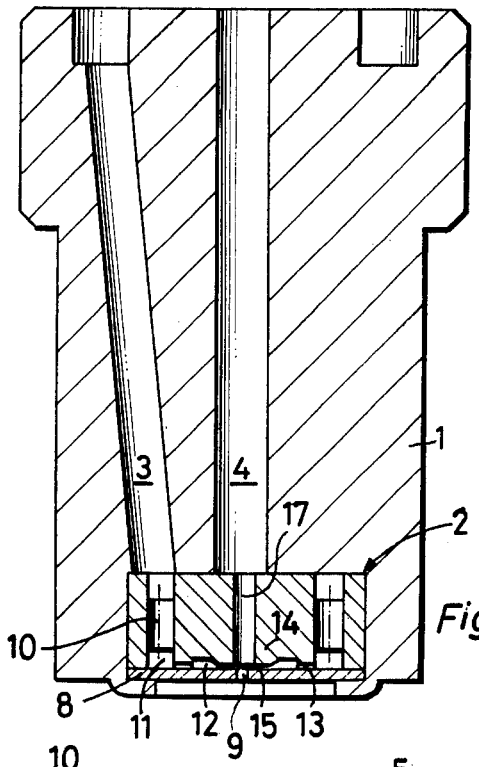
FIG. 1 is a longitudinal sectional view through an injection nozzle formed in accordance with this invention and mounted in a nozzle holder.

Referring now to the drawings in detail, reference is first made to FIG. 1 wherein there is illustrated a conventional nozzle holder 1 having a recess in the lower end thereof in which an injection nozzle 2 is positioned. The nozzle holder 1 is provided with a supply conduit 3 for supplying the injection substance to the nozzle 2, and a central return channel 4.

Figure 5:
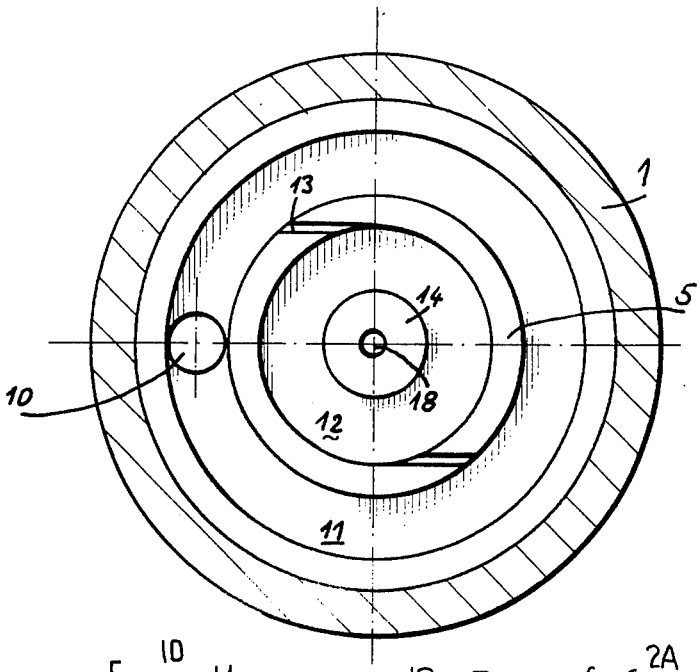
FIG. 5 is an enlarged transverse sectional view taken along the line V — V of FIG. 4 and shows further the specific constructional details of the nozzle.
Figure 4:
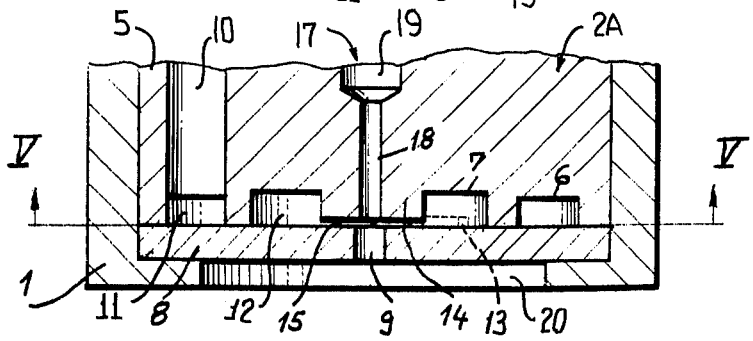
FIG. 4 is another longitudinal fragmentary vertical sectional view of an embodiment of the injection nozzle.

Reference is now made to FIGS. 4 and 5 wherein the specific details of an injection nozzle 2A is illustrated. The injection nozzle 2A includes a nozzle body 5 which is of a size to snugly fit within the lower part of the nozzle holder 1. The nozzle body 5 has an end thereof which faces outwardly through an opening 20 formed in the dischange end of the nozzle holder 1. Seated in the end of the holder 1 and generally closing the opening 20 is a cover plate 8 which bears against the discharge end of the nozzle body 5.

The nozzle body 5 has an inlet bore 10 extending axially therethrough and being placed in communication with the supply line 3 of the nozzle holder 1 by way of an annular channel, as is best shown in FIG. 1. The supply passage 10 is in communication with an inlet chamber 11 which is defined in part by an annular channel 6 formed in the end face of the nozzle body 5 and in part by the cover plate 8.

Disposed radially inwardly of the channel 6 is another annular channel 7 which defines a core 14. The channel 7, together with the cover plate 8, defines a spinning chamber 12. With particular reference to FIG. 5, it will be seen that the spinning chamber 12 is placed into communication with the inlet chamber 11 by means of spinning channels 13 which open inwardly from the inlet chamber 11 substantially tangentially into the spinning chamber 12.

It will be seen that the end surface of the core 14 opposes, but is spaced from the cover plate 8 so as to define a gap 15. It is also to be noted that opposing the end surface of the core 14 is a bore defining an exhaust orifice 9. Thus, all material to be injected by way of the injection nozzle 2A must pass through the very narrow gap 15 from the spinning chamber 12 to the exhaust orifice 9. The cross section of the exhaust orifice 9 is materially greater than that of the gap 15, and therefore, the gap 15 forms a controlling narrow passage with respect to the injection of a liquid by the injection nozzle.

It is also to be noted that the nozzle body 5 is provided with a through bore generally identified by the number 17 which is aligned with the exhaust orifice 9. The bore 17 includes a portion 18 of reduced diameter opening through the end surface of the core 14 and a further portion 19 of a larger diameter which is adapted to be placed into communication with the return channel 4. It is further to be noted that the bore 18 is of a smaller cross section than the exhaust orifice 9. The bore 18 opening through the end surface of the core 14 provides a sharp edge over which the injected material must pass as it flows along the end surface of the core 14 and this sharp edge provides for a better atomization of the injected liquid in the area of the exhaust orifice 9.

Reference is now made to the embodiment of FIG. 1 wherein it will be seen that the nozzle body 2 is identical with the nozzle body 2A except that the through bore 17 thereof is of a constant diameter, which diameter is greater than that of the exhaust orifice 9 and less than that of the return passage 4.

Figure 2:
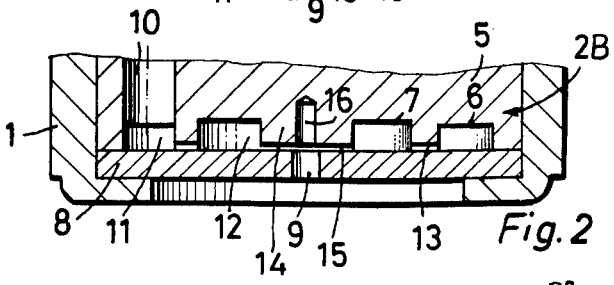
FIG. 2 is an enlarged fragmentary longitudinal sectional view through the discharge end of a modified form of nozzle construction.

Reference is now made to FIG. 2 wherein still another form of injection nozzle 2B is illustrated. It is to be noted that the nozzle body 5 is provided with a bore 16 in the core 14 in alignment with the exhaust orifice 9 so as to provide the desired sharp edge for better atomization. On the other hand, the bore 16 is a blind bore and there is no return of the liquid through the nozzle body 5.

Figure 3:
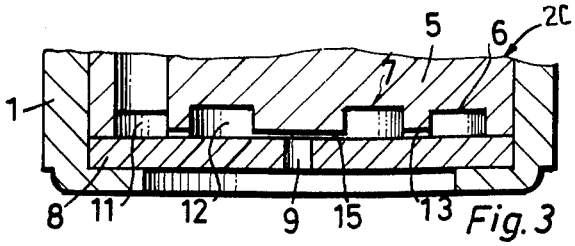
FIG. 3 is an enlarged longitudinal sectional view through the discharge portion of still another form of injection nozzle.

In FIG. 3 there is illustrated an embodiment of the invention wherein there is no bore for the purpose of providing a sharp edge for a better atomization in the region of the exhaust orifice 9. However, the embodiment of this Figure still employs the gap 15 which is the principal feature of this invention. The injection nozzle of FIG. 3 is identified by the reference number 2C.

Figure 6:
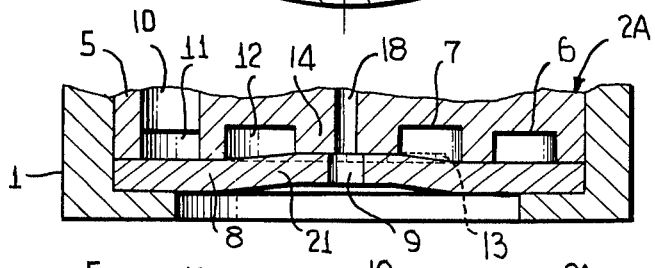
FIG. 6 is an enlarged fragmentary longitudinal sectional view of still another embodiment of nozzle construction.

At this time it is pointed out that it is not necessary that the gap 15 normally exist. The cover plate 8 may be so constructed so as to normally resiliently engage the end surface of the core 14 so as to make the gap substantially non-existent when there is no pressure within the spinning chamber 12. The resilient engagement of the cover plate 8 with the end surface of the core 14 may be accomplished in various manner and merely for the purpose of illustration, the cover plate 8 is shown in FIG. 6 as including an upwardly bowed central portion 21 which is in resilient engagement with the core 14. It is to be understood that the cover plate 18 will deflect downwardly under pressure of material to be injected disposed within the spinning chamber 12 so as to produce the necessary gap 15 for the proper injection of the material through the injection nozzle and out through the exhaust orifice 9.

In the embodiment of the invention illustrated in FIG. 6, the nozzle body is identical to the nozzle body 2A but it is to be understood that the nozzle body associated with a cover plate which is resiliently engaged with the core 14 may be any one of the other nozzle bodies 2,2B and 2C.

Nozzles in accordance with this disclosure have been constructed and experiments have shown that injection ratios on the order of 1 : 100 are feasible, which injection ratios are far beyond those which were previously considered feasible. It will, therefore, be readily apparent that injection nozzles constructed in accordance with this invention will be especially suited for combustion engines operated with different fuels, i.e. the so-callel all-fuel engines.

Although only several preferred embodiments of the invention have been specifically illustrated and described herein, it is to be understood that minor variations may be made in the nozzle constructions without departing from the spirit and scope of the invention, as defined by the appended claims.

What is claimed as new:

1. An injection nozzle for liquids, said injection nozzle comprising a nozzle body having a discharge end, a cover plate opposing said nozzle body discharge end, said discharge end being configurated to define a central core having an end surface, said cover plate having an exhaust orifice therethrough in alignment with said core, said core end surface being of a greater size than said exhaust orifice and completely overlying said exhaust orifice, an annular recess in said nozzle body surrounding said core and together with said cover plate defining a spinning chamber, an inlet channel disposed outwardly of said spinning chamber, said inlet channel being defined by a recess in said nozzle body with said recess being closed by said cover plate, and spin channels extending from said inlet channel substantially tangentially into said spinning chamber immediately above said cover plate, said cover plate being permanently spaced from said core end surface and defining between said cover plate and said core end surface a narrow gap through which liquid being injected passes from said spinning chamber into said exhaust orifice, said spin channels discharging into said spinning chamber substantially at the level of said gap, and said gap having a flow section at the periphery of said core materially less than the cross section of said exhaust orifice.

2. An injection nozzle for liquids, said injection nozzle comprising a nozzle body having a discharge end, a cover plate opposing said nozzle body discharge end, said discharge end being configurated to define a central core having an end surface, said cover plate having an exhaust orifice therethrough in alignment with said core, said core end surface being of a greater size than said exhaust orifice and completely overlying said exhaust orifice, an annular recess in said nozzle body surrounding said core and together with said cover plate defining a spinning chamber, an inlet channel disposed outwardly of said spinning chamber, and spin channels extending from said inlet channel substantially tangentially into said spinning chamber, said cover plate at least in the operating condition of said nozzle being spaced from said core end surface and defining between said cover plate and said core end surface a narrow gap through which liquid being injected passes from said spinning chamber into said exhaust orifice, said gap having a flow section at the periphery of said core materially less than the cross section of said exhaust orifice, said cover plate normally having a portion thereof offset towards said core and elastically abutting said core end surface with said cover plate being urged towards a planar state under pressure.

3. An injection nozzle as defined in claim 2 wherein said cover plate is in the form of a sheet-like disc.

4. An injection nozzle for liquids including fuels, said injection nozzle comprising a nozzle body having a discharge end, a cover plate opposing said nozzle body discharge end, said discharge end being configurated to define a central core having an end surface, said cover plate having an exhaust orifice therethrough in alignment with said core, an annular recess in said nozzle body surrounding said core and together with said cover plate defining a spinning chamber, an outer inlet channel, and spin channels extending from said inlet channel substantially tangentially into said spinning chamber, said cover plate at least in the operating condition of said nozzle being spaced from said core end surface and defining between said cover plate and said core end surface a narrow gap through which liquid being injected passes from said spinning chamber into said exhaust orifice, said gap having a flow section at the periphery of said core materially less than the cross section of said exhaust orifice, and a bore in said nozzle body extending inwardly from said core end away from said exhaust orifice, said bore being generally axially aligned with said exhaust orifice and inwardly of said gap.

5. An injection nozzle as defined in claim 4 wherein at least that portion of said bore opening through said core end surface is of a cross section less than that of said exhaust orifice.

6. An injection nozzle as defined in claim 5 wherein said bore is a through bore and forms a return path for fluid.

7. An injection nozzle as defined in claim 4 wherein said bore is a through bore and forms a return path for fluid.

8. An injection nozzle as defined in claim 4 wherein at least that portion of said bore opening through said core end surface is of a cross section greater than that of said exhaust orifice.

9. An injection nozzle as defined in claim 4 wherein said bore is a blind bore.

* * * * *